US007849522B2

(12) United States Patent
Roux

(10) Patent No.: US 7,849,522 B2
(45) Date of Patent: Dec. 14, 2010

(54) ARTICLE OF CLOTHING

(75) Inventor: Isabelle Roux, Metz-Tessy (FR)

(73) Assignee: Salomon S.A.S., Metz-Tessy (FR)

( * ) Notice: Subject to any disclaimer, the term of this patent is extended or adjusted under 35 U.S.C. 154(b) by 0 days.

(21) Appl. No.: 11/780,308

(22) Filed: Jul. 19, 2007

(65) Prior Publication Data

US 2007/0256207 A1 Nov. 8, 2007

Related U.S. Application Data

(63) Continuation of application No. 10/820,702, filed on Apr. 9, 2004, now abandoned.

(30) Foreign Application Priority Data

Apr. 10, 2003 (FR) ..... 03 04440

(51) Int. Cl.
*A41D 1/08* (2006.01)

(52) U.S. Cl. ..... 2/227; 2/228

(58) Field of Classification Search ..... 2/69, 2/227, 228, 77, 67, 231, 232, 233, 242, 408, 2/104, 269

See application file for complete search history.

(56) References Cited

U.S. PATENT DOCUMENTS 557,563 A * 4/1896 Dunning ..... 2/401
1,143,282 A * 6/1915 King ..... 2/83
1,277,074 A * 8/1918 Hitzeman ..... 2/78.3
1,633,610 A * 6/1927 Schneider ..... 2/407
1,652,750 A * 12/1927 Wohlgemuth ..... 2/227
1,691,057 A * 11/1928 Greilich ..... 2/227
1,784,285 A * 12/1930 Heaton ..... 2/270
2,034,312 A 3/1936 Rubin
2,112,788 A 3/1938 Rosenberg
2,274,270 A * 2/1942 Kalb ..... 2/227
2,391,535 A 12/1945 Zelano
2,446,326 A 8/1948 Guithes
2,448,705 A * 9/1948 Dobson ..... 2/70
2,494,261 A 1/1950 Owenby
2,592,665 A 4/1952 Deutsch et al.
2,599,769 A 6/1952 MacRae et al.
2,705,804 A * 4/1955 Walker ..... 2/83
2,716,754 A * 9/1955 Hirsch ..... 2/227
2,873,738 A 2/1959 Stark
2,967,308 A * 1/1961 Freese, Jr. ..... 2/270
2,983,924 A 5/1961 Cohen et al.
2,997,765 A * 8/1961 Markoff-Moghadam ..... 24/400
3,496,572 A * 2/1970 Benno ..... 2/457
3,671,975 A * 6/1972 Vorsteher ..... 2/232
3,678,514 A * 7/1972 Safrit ..... 2/212
3,733,615 A * 5/1973 Jaffee ..... 2/232

(Continued)

FOREIGN PATENT DOCUMENTS

FR 2 853 498 A1 10/2004
GB 479997 2/1938

*Primary Examiner*—Alissa L Hoey
(74) *Attorney, Agent, or Firm*—Greenblum & Bernstein, P.L.C.

(57) ABSTRACT

An article of clothing that includes a snugly fitting inner portion having at least one connecting band extending along at least one limb (such as an arm, leg) of the body of the wearer, a more loosely fitting outer portion covering the inner portion, the inner and outer portions being assembled to one another by the connecting band extending along at least one limb.

33 Claims, 4 Drawing Sheets

U.S. PATENT DOCUMENTS 3,763,579 A * 10/1973 Dexter ..... 36/50.1
4,017,910 A * 4/1977 Bente ..... 2/232
4,184,494 A 1/1980 King, Jr.
4,488,317 A * 12/1984 Polsky ..... 2/227
4,543,670 A * 10/1985 Ehring ..... 2/85
4,578,828 A * 4/1986 Smith et al. ..... 2/234
4,631,753 A * 12/1986 Ehring ..... 2/85
4,670,913 A * 6/1987 Morell et al. ..... 2/227
4,785,480 A 11/1988 Polsky
4,843,654 A 7/1989 March
4,918,760 A 4/1990 Grilliot et al.
5,010,595 A * 4/1991 Stradley ..... 2/227
5,033,124 A * 7/1991 Bucalo et al. ..... 2/227
5,218,720 A * 6/1993 Tolton ..... 2/97
5,487,710 A * 1/1996 Lavorgna et al. ..... 482/55
5,572,737 A 11/1996 Valice
5,598,586 A 2/1997 Munjone
5,613,378 A * 3/1997 Popa et al. ..... 66/176
5,649,328 A * 7/1997 Martin ..... 2/238
5,664,256 A * 9/1997 Blauer et al. ..... 2/69
5,746,068 A * 5/1998 Popa et al. ..... 66/176
5,774,892 A * 7/1998 Tisdale et al. ..... 2/69
5,790,984 A * 8/1998 Doubleday ..... 2/69
5,794,268 A * 8/1998 Pessey ..... 2/227
5,978,971 A 11/1999 Wald
6,115,850 A 9/2000 Grilliot et al.
6,145,132 A 11/2000 Towner
6,161,223 A * 12/2000 Andrews ..... 2/234
6,243,871 B1 6/2001 Fidler
6,243,878 B1 * 6/2001 Khemka et al. ..... 2/227
6,401,250 B1 * 6/2002 McNabb ..... 2/78.2
6,477,716 B2 * 11/2002 Blaire ..... 2/227
6,651,257 B2 * 11/2003 Smith ..... 2/239
6,665,882 B1 12/2003 Pedrick
6,789,270 B1 9/2004 Pedrick
6,839,909 B1 * 1/2005 Prince ..... 2/81
2001/0002493 A1 6/2001 Wheeler et al.
2002/0116748 A1 8/2002 Lipsett et al.
2002/0120977 A1 * 9/2002 Smith ..... 2/242
2003/0208829 A1 * 11/2003 Ragot et al. ..... 2/67
2005/0066408 A1 * 3/2005 Varela ..... 2/69
2006/0096008 A1 * 5/2006 Lin ..... 2/242

* cited by examiner

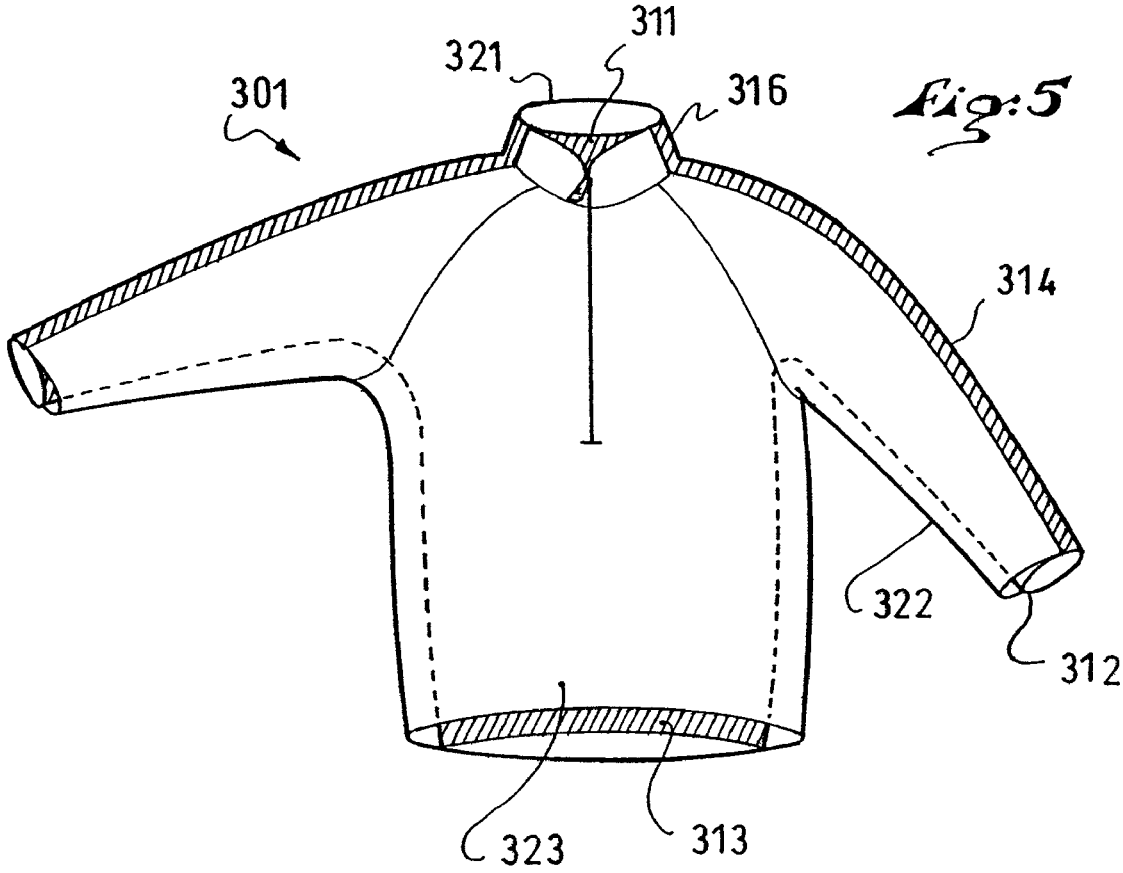
Fig: 5
Fig: 6
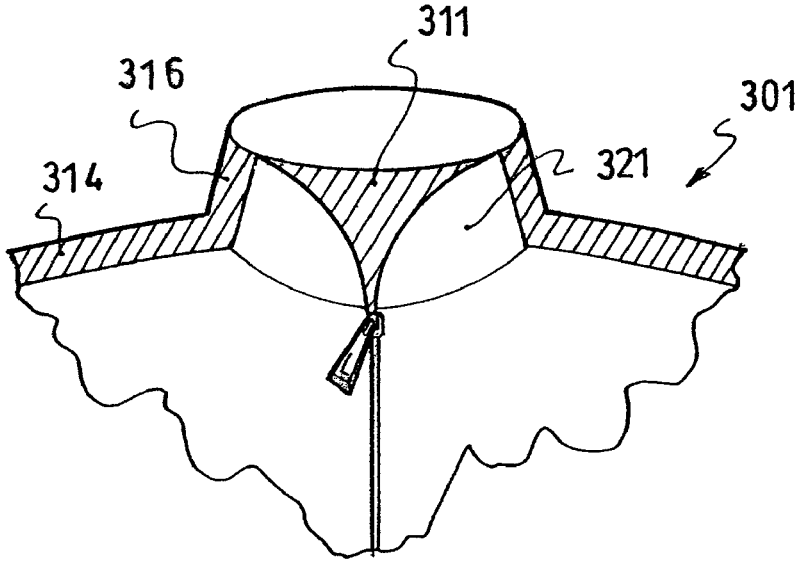

ARTICLE OF CLOTHING

CROSS-REFERENCE TO RELATED APPLICATIONS

This application is a continuation of U.S. patent application Ser. No. 10/820,702, which had been filed on Apr. 9, 2004, the disclosure of which is hereby incorporated by reference thereto in its entirety, and the priority of which is hereby claimed under 35 U.S.C. §120.

This application is based upon French Patent Application No. 03.04440, filed Apr. 10, 2003, the disclosure of which is hereby incorporated by reference thereto in its entirety and the priority of which is hereby claimed under 35 U.S.C. §119.

BACKGROUND OF THE INVENTION

1. Field of the Invention

The present invention relates to an article of clothing having at least one extensible portion.

2. Description of Background and Other Information

Garments of the above-mentioned type are known to be used for sporting activities, particularly garments such as shorts or thigh-pieces, or pants, or tops covering the torso.

Indeed, the elastic materials used in such garments allow for a good support for the wearer's muscles during sports activity. Depending on the type of material used, they also facilitate proprioceptive sensing that can be useful for the particular sports activity, and they can also guarantee a certain degree of warmth for the muscles.

However, because they are made of elastic materials, these garments fit snugly and can provide an undesirable visual appearance, particularly if the wearer has an unflattering physical appearance such as being overweight, for example, or if the wearer simply does not desire a snugly fitted appearance.

Moreover, it is difficult to wear garments of this type for purposes other than sporting activities.

To overcome these drawbacks, it is known to superimpose several garments, the one made of an elastic material fitting snugly, such as a thigh-piece, and another, fitting more loosely, such as shorts.

This practice is common with certain athletes, such as soccer players, rugby players, or runners. It has the drawback of requiring two garments, and of increasing the risks of wear of the loose garment in the friction zones, especially in the crotch area in the case of shorts or pants. Furthermore, the outer loose garment can generate unpleasant or undesirable sounds in the friction zones, depending upon the material(s) of which it is made, and the superimposition of two layers of materials in certain zones, and especially in the crotch area, can generate excessive heating.

SUMMARY OF THE INVENTION

An object of the present invention is to overcome the aforementioned drawbacks and to provide an article of clothing that allows combining a pleasant aesthetic outer appearance and good support and/or heating of the muscles, and/or a proprioceptive effect.

These objects are achieved in the article of clothing having at least one extensible portion according to the invention, whereby the article of clothing comprises a snugly fitting inner portion having at least one connecting band extending along at least one limb or extremity (arm, leg, neck) of the body, or body part, and of a loosely fitting outer portion covering the inner portion, and whereby the inner portion and the outer portion are assembled together by the connecting band.

BRIEF DESCRIPTION OF DRAWINGS

The invention will be better understood, and other characteristics thereof will become apparent from the following description, as well as with reference to the annexed schematic drawings showing several embodiments, by way of non-limiting examples, and in which:

FIG. 5 is a view, similar to FIG. 1, showing a fifth embodiment of the invention;

FIG. 6 is a detailed view of FIG. 5;

DETAILED DESCRIPTION OF THE INVENTION

Figure 1:
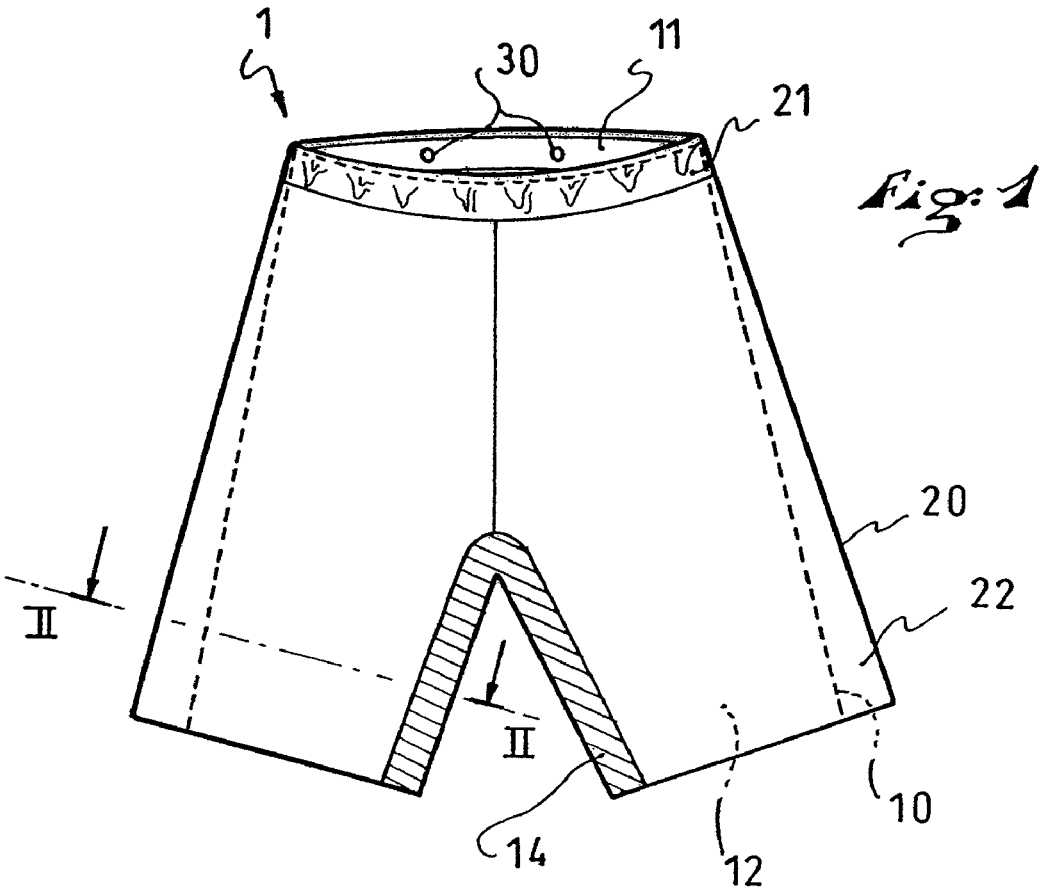
FIG. 1 is a front view of an article of clothing, such as shorts, incorporating the invention.
Figure 2:
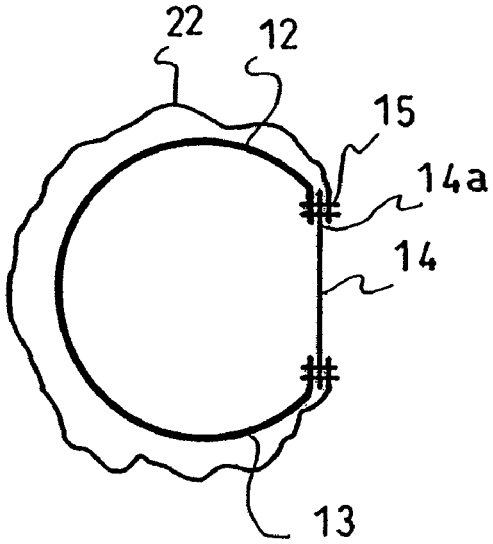
FIG. 2 is a cross-sectional view taken along the line II-II of FIG. 1.

FIGS. 1 and 2 show an article of clothing of the shorts type incorporating the invention.

These shorts 1 comprise two portions, namely:

- inner snugly fitting shorts 10 made at least partially of an elastic material such as that known by the registered marks "LYCRA®" or "LYCRA POWER®," polyamide, or made of a breathable or elastic mesh-type material; and
- outer loosely fitting shorts 20 made of a non-elastic material, such as Nylon, or made of a breathable material of the mesh-type.

The inner shorts 10 have a waist 11 and two legs 12.

Each leg 12 includes a tubular, or partially cylindrical, portion 13, having semi-cylindrical or partially cylindrical shape, the portion 13 comprising an elastic material. Each leg 12 also includes a connecting band 14 covering the crotch area and having an outer exposed surface. The connecting band 14 can be made of an elastic material, or rather of a non-extensible material.

The outer shorts 20 also have a waist 21 and two substantially tubular portions each comprising a leg 22.

As shown clearly in FIG. 2, each leg 22 of the outer shorts is assembled to the associated leg 12 of the inner shorts 10 along the edges 14*a* of the connecting band 14 by means of seams 15, such as stitching. As also shown in FIG. 2, the connecting band 14 connects a pair of transversely spaced-apart longitudinal edges of the leg 12 and a pair of such edges of the leg 22, such that, in the embodiment illustrated in FIGS. 1 and 2, the outer portion/leg 22 overlies the inner portion/leg 12 along less than the entirety of the transverse periphery of the body part of the wearer, with the connecting band 14 connecting the pair of peripherally spaced-apart longitudinally extending edges of each leg/portion 12, 22.

As a result, the inner 10 and outer 20 shorts in fact have a common portion in the form of the connecting band 14 in the crotch area. In addition, as can be seen in FIG. 2, the shorts have a double layer, i.e., inner and outer layers, comprised of inner and outer portions 10, 20, and one layer less than that in the area of the connecting band.

Thus, friction that could otherwise generate noise and wear between the two legs of the loosely fitting outer shorts 20 during use is avoided.

Furthermore, a good aesthetic appearance of the loosely fitting shorts 20 is guaranteed, because the snugly fitting inner shorts 10 remain hidden, or mostly hidden, by the outer shorts.

In a particular embodiment, the legs 12 of the inner shorts are not longer than those of the outer shorts, in order to prevent any visual impression of a snug fit.

However, it is contemplated according to the invention that they can be slightly shorter so as not to extend beyond the outer shorts.

It is noted that the connection of the two shorts to one another is particularly important in this context, in order to prevent a relative slip of the legs during the sporting activity and to maintain the visual appearance of the loosely fitting shorts.

The inner shorts can also be provided to have longer legs 12 than those of the outer shorts if a mixed visual appearance is desired.

In a particular embodiment, the waists 11, 21 of the shorts 10, 20 are separate, and the shorts are therefore only connected to one another by the crotch, so as to guarantee a better adaptation to the wearer's movements. As a result, the outer shorts do not hinder the movements of the inner shorts. As can be seen in FIG. 2, a space can be seen between the inner leg 12 and the outer leg 22. In other words, below the intersection of the left and right legs at the crotch, the inner and outer legs 12, 22 of the shorts are connected to one another, in a direction around a transverse periphery of the longitudinally extending legs, only by means of the connecting band 14. As a result, there is an air gap between the more tightly fitting inner shorts 10 and the more loosely fitting outer shorts 20 and, further, the more loosely fitting outer shorts 20 are movable relative to the inner shorts 10. Stated another way, based upon the foregoing description and the drawing figures, the overlying outer shorts 20 are movable relative to the underlying surface of the inner shorts 10, particularly as the outer shorts 20 are not fit snugly to the body of the wearer.

The connecting band 14, as well as the connecting bands of other embodiments described below, extends from a joint between a torso and a limb or extremity of the wearer and along a length of the limb or extremity. Such joint in the embodiment of FIGS. 1 and 2, for example, is the crotch between the torso and the two legs of the wearer. In other embodiments, such joint includes an armpit, i.e., the joint between the torso and an arm of the wearer, or the joint between the neck of the wearer and either of the shoulders of the wearer.

As shown in FIG. 1, detachable connectors 30, or connecting mechanisms, such as buttons or snap fasteners, can be provided to tie the waists 11 and 21 together and in particular to enable the double shorts 1 to be put on easily.

As the case may be, the connectors 30 can also be provided to be permanent. In that case, it will be a seam, etc., such as stitching.

According to a particular embodiment, the connectors 30 are constituted by connecting straps, such that the inner shorts 10 somewhat hang, or are suspended, within the outer shorts 20. In this case, the straps are preferably made of an elastic material in order to better follow the movements of the wearer.

The connecting band 14 of the crotch can have a substantially rectangular shape, or a triangular shape, for example, depending on the cut of one or both shorts 10, 20.

The connecting band 14 can be provided in the form of a yoke that is distinct from the inner shorts 10 as shown in FIG. 1 or 2, or, on the contrary, it can be an integral part of each leg 12, these legs then being made, for example, by knitting. This is especially the case when the connecting band 14 is made of an elastic material. In such an embodiment, in addition to the outer portion 22 of the garment being said to be positioned over the inner portion 12, it can be said that outer portion 22 is positioned over a part of the inner portion, whereby the outer portion 22 is not positioned over the part of the inner portion that constitutes the connecting band 14.

In the case where each band 14 is constituted by a distinct yoke, it can be made either of the same material as the associated leg 12, or of a different material, and, in particular, a non-elastic material. As the case may be, the material can also be a breathable material of the mesh-type or the perforated fabric-type, for a better ventilation.

Figure 3:
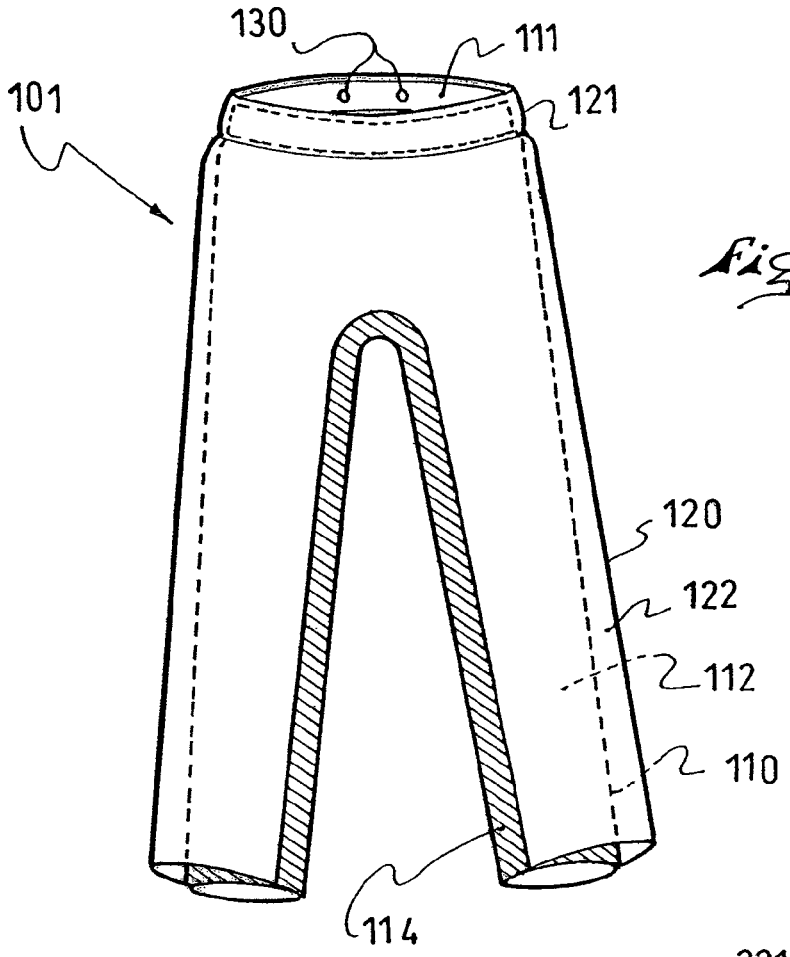
FIG. 3 is a view, similar to FIG. 1, showing a second embodiment of the invention.

FIG. 3 shows pants 101, for which similar or identical portions/elements are designated by the same reference numerals used in FIGS. 1 and 2 increased by 100.

In the case of FIG. 3, the pants also have inner pants 110 provided with a waist 111 and legs 112, and outer pants 120 provided with a waist 121 and legs 122.

As mentioned above, detachable connectors 130 are provided in the crotch area by a common connecting band 114, which can be made of an elastic material.

Figure 4:
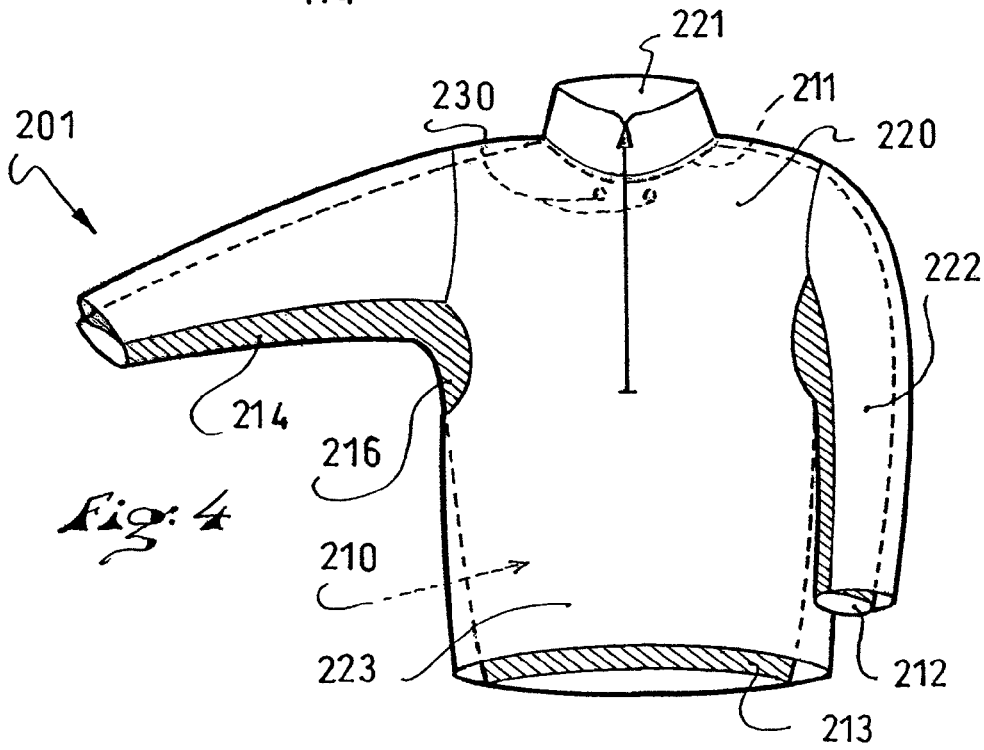
FIG. 4 is a view, similar to FIG. 1, showing a fourth embodiment of the invention.

FIG. 4 shows another application of the present invention to an article of clothing 201 such as a jacket, a sweater, etc., i.e., covering the upper portion of the body.

In this case, the top 201, as previously mentioned, has a snugly fitting inner top 210 and a loosely fitting outer top 220.

As mentioned above, each top 210, 220 has a collar 211, 221 respectively, and sleeves 212, 222, respectively, as well as a bust or torso portion 213, 223, respectively.

As mentioned above, these two tops 210, 220 are independent of one another, except in the area of the sleeves 212, 222 adapted to cover the wearer's arms.

In this case, the sleeves 212, 222 are connected to one another by a connecting band 214 in the area of their lower portion, i.e., located on the side of the torso 213, 223.

This connecting band 214 is preferably extended by a connecting portion 216 in the zone of the corresponding bust, i.e., in the armpit area.

As in the case of the shorts or pants previously described, these connecting bands 214, 216 are located in a friction zone, and the previously mentioned problems related to wear and noise are avoided.

As mentioned above, removable connectors 230 can be provided between the two collars 211, 221. In the example shown, the collar 211 is low, whereas the collar 221 is high. The collar 221 could also be low, or the collar 221 could also be high.

FIGS. 5 and 6 show another example of application of the present invention to a top 300. In these figures, similar elements are designated by the same reference numerals as in FIG. 4, increased by 100.

The main difference with respect to the embodiment of FIG. 4 lies in the fact that the connecting band 314 between the sleeves 312, 322 respectively, extends over the upper portion of the sleeves 312, 322, respectively, and is extended on the collar by a connecting band 316.

A connection is thus obtained between the inner garment and the outer garment, not only in the area of the sleeves but also in the area of each side of the collar.

In the example shown, the two collars 311, 321 are high; they could also be lower, the connecting band 316 being more reduced in this case.

Figure 7:
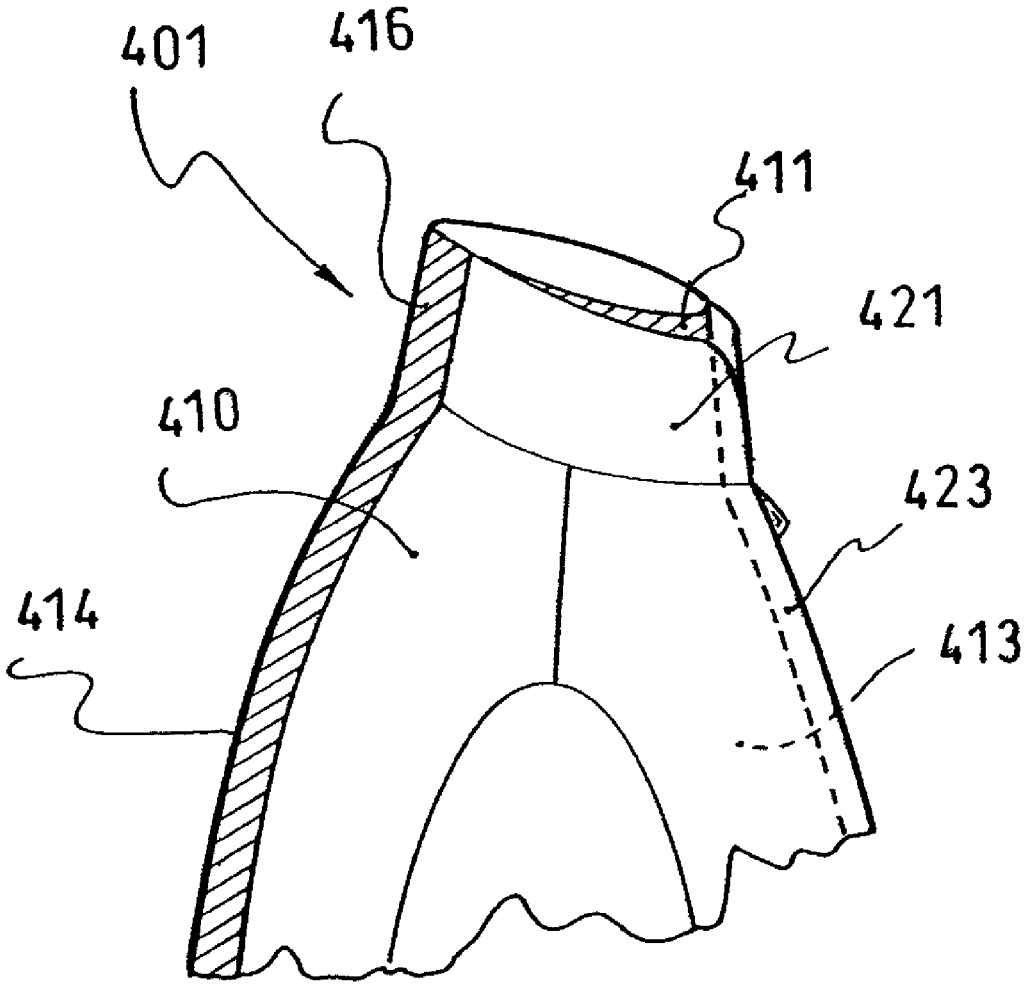
FIG. 7 is a detailed view, similar to FIG. 6, according to a sixth embodiment of the invention.

In the embodiment shown in FIG. 7, in which similar or identical elements are designated by the same reference numerals increased by 100, the elastic connecting band 414 extends in the back of the garment, preferably, but in a non-limiting manner, in a median zone of the latter, thus connecting the portions 413, 423 covering the bust.

It is extended in the area of the collar by a connecting band 416 that also connects the inner collar 411 and the outer collar 421.

As previously mentioned, the visual appearance of a loose garment is nevertheless preserved, this appearance being particularly important when seen from the front.

The present invention is not limited to the particular embodiments described hereinabove and shown in the drawings by way of non-liming examples, but encompasses all of the embodiments that are similar or equivalent and/or aim at solving the same problems.

In particular, in all examples shown, the sleeves, legs, bust, collars, etc., of the garments shown can have various lengths. Similarly, the connecting bands can be made of an elastic or non-elastic material, without leaving the scope of the present invention. In addition, as shown in the drawings, the connecting bands are continuous and uninterrupted along their widths, i.e., continuous and uninterrupted in a direction around a limb or extremity, such as connecting band 14 of FIGS. 1 and 2, which band 14 is continuous and uninterrupted between seams 15. For example, no reversible fasteners, such as slide fasteners, e.g., are shown in the drawings to be attached to the connecting bands.

The invention claimed is:

1. An article of clothing comprising:

an inner portion comprising an elastic material, said inner portion being adapted to fit snugly to a limb or extremity of a wearer;

an outer portion, adapted to fit more loosely to the wearer than the inner portion, said outer portion being positioned over at least a part of the inner portion along the limb or extremity and being movable relative to the inner portion, a space being located between the outer portion and an underlying surface of the inner portion;

a connecting band adapted to extend along at least one limb or extremity of the wearer, said connecting band assembling the outer portion to the inner portion at spaced-apart edges of the connecting band;

the connecting band extending in an area of the connecting band is located in a crotch area of an article of clothing;

the connecting band having a continuous extent along a transverse direction around the limb or extremity between the two spaced-apart edges of the outer portion;

a lower edge region of the outer portion being freely movable relative to the inner portion.

2. An article of clothing according to claim 1, wherein:

the outer portion covers the inner portion completely.

3. An article of clothing according to claim 1, wherein:

the connecting band is located in a friction zone of the article of clothing.

4. An article of clothing according to claim 3, wherein:

the connecting band is made of an elastic material.

5. An article of clothing according to claim 1, wherein:

the connecting band is made of an elastic material.

6. An article of clothing according to claim 1, wherein:

the connecting band comprises an inextensible material.

7. An article of clothing according to claim 3, wherein comprising:

an inner portion comprising an elastic material, said inner portion being adapted to fit snugly to a limb or extremity of a wearer;

an outer portion, adapted to fit more loosely to the wearer than the inner portion, said outer portion being positioned over at least a part of the inner portion along the limb or extremity and being movable relative to the inner portion, a space being located between the outer portion and an underlying surface of the inner portion;

a connecting band adapted to extend along at least one limb or extremity of the wearer, said connecting band assembling the outer portion to the inner portion at spaced-apart edges of the connecting band;

the connecting band being located in a friction zone of the article of clothing;

a lower edge region of the outer portion being freely movable relative to the inner portion;

the article of clothing includes two legs, the friction zone being a crotch area of each of the two legs;

the connecting band being located along the crotch area of each of the two legs of the article of clothing.

8. An article of clothing according to claim 7, wherein:

the article of clothing is shorts.

9. An article of clothing according to claim 7, wherein:

the article of clothing is pants, the two legs of the pants adapted to extend along substantially an entirety of respective legs of the wearer.

10. An article of clothing comprising:

an inner portion comprising an elastic material, said inner portion being adapted to fit snugly to a limb or extremity of a wearer;

an outer portion, adapted to fit more loosely to the wearer than the inner portion, said outer portion being positioned over at least a part of the inner portion along the limb or extremity and being movable relative to the inner portion, a space being located between the outer portion and an underlying surface of the inner portion;

a connecting band adapted to extend along at least one limb or extremity of the wearer, said connecting band assembling the outer portion to the inner portion at spaced-apart edges of the connecting band;

the connecting band being located in a friction zone of the article of clothing;

the connecting band being made of an elastic material;

a lower edge region of the outer portion being freely movable relative to the inner portion;

the article of clothing including two legs, the friction zone being a crotch area of each of the two legs;

the connecting band being located along the crotch area of each of the two legs of the article of clothing.

11. An article of clothing according to claim 1, wherein:

the lower edge region of the outer portion being freely movable relative to a lower edge region of the inner portion.

12. An article of clothing according to claim 1, wherein:

the elastic material is structured and arranged to extend along at least one limb or extremity of a body portion of the wearer.

13. An article of clothing according to claim 1, wherein:

the connecting band comprises an elastic material.

14. An article of clothing according to claim 1, wherein:

the inner and outer portions comprise a plural number of layers of material;

the connecting band comprises one layer of material fewer than said number of layers of material comprised by the inner and outer portions.

15. An article of clothing according to claim 1, wherein:
said connecting band has an outer exposed surface extending in a direction along a length of the limb or extremity away from a joint between a torso and the limb or extremity of the wearer.

16. An article of clothing according to claim 1, wherein:
the connecting band is assembled to the inner and outer portions along a first seam extending along a first edge of the connecting band; and along a second seam extending along a second edge of the connecting band, said first and second edges of the connecting band being spaced apart along a width of the connecting band.

17. An article of clothing according to claim 1, wherein:
in a single transverse cross section extending through the inner portion, through the outer portion, and through the connecting band, said space is located between the outer portion and the underlying surface of the inner portion.

18. An article of clothing according to claim 1, wherein:
the outer portion does not extend around an entirety of a transverse periphery of the limb or extremity of the body of the wearer.

19. An article of clothing comprising:
an inner portion adapted to extend in a direction around a transverse periphery of a limb or extremity of a wearer;
an outer portion overlying the inner portion along less than an entirety of the transverse periphery of the limb or extremity of the wearer, at least the outer portion having a pair of peripherally spaced-apart edges extending longitudinally in a direction of a length of the limb or extremity of the wearer;
a connecting band extending longitudinally in the direction of the length of the limb or extremity and having a width extending between and connecting the pair of peripherally spaced-apart longitudinally extending edges of the outer portion, the connecting band is located in a crotch area of an article of clothing;
the inner and outer portions collectively comprise a plural number of layers of material;
the connecting band comprises one layer of material fewer than said number of layers of material collectively comprised by the inner and outer portions;
the overlying outer portion being movable relative to an underlying surface of the inner portion;
a space being located between the outer portion and the underlying surface of the inner portion;
a lower edge region of the outer portion being freely movable relative to the inner portion.

20. An article of clothing according to claim 19, wherein:
the connecting band comprises a material distinct from and assembled to the inner and outer portions.

21. An article of clothing according to claim 19, wherein:
the connecting band comprises an elastic material.

22. An article of clothing according to claim 21, wherein:
the elastic material is structured and arranged to extend along at least one limb or extremity of a body portion of the wearer.

23. An article of clothing according to claim 19, wherein:
the connecting band comprises an inextensible material;
the inner portion comprises an elastic material.

24. An article of clothing according to claim 19, wherein:
the inner portion is adapted to fit snugly to the limb or extremity of the wearer while the outer portion is not fit snugly to the limb or extremity of the wearer.

25. An article of clothing according to claim 19, wherein:
both of the inner and outer portions have respective pairs of peripherally spaced-apart longitudinally extending edges.

26. An article of clothing comprising:
an inner portion comprising an elastic material, said inner portion being adapted to fit snugly to a limb or extremity of a wearer;
an outer portion, adapted to fit more loosely to the wearer than the inner portion, said outer portion being positioned over at least a part of the inner portion along the limb or extremity and being movable relative to the inner portion, a space being located between the outer portion and an underlying surface of the inner portion;
a connecting band adapted to extend along at least one limb or extremity of the wearer, said connecting band assembling the outer portion to the inner portion at spaced-apart edges of the connecting band;
the connecting band having a continuous extent along a transverse direction around the limb or extremity between the two spaced-apart edges of the outer portion said connecting band extends in a crotch region of an article of clothing;
a lower edge region of the outer portion being freely movable relative to the inner portion;
the connecting band being uninterrupted by a reversible fastener along a direction around the limb or extremity.

27. An article of clothing according to claim 19, wherein:
the connecting band is uninterrupted by a reversible fastener along a direction around the limb or extremity of the wearer.

28. An article of clothing according to claim 19, wherein:
the connecting band is uninterrupted by a slide fastener along a direction around the limb or extremity of the wearer.

29. An article of clothing according to claim 19, wherein:
the lower edge region of the outer portion being freely movable relative to a lower edge region of the inner portion.

30. An article of clothing according to claim 19, wherein:
the connecting band comprises an elastic material;
the inner portion comprises an elastic material.

31. An article of clothing according to claim 19, wherein:
said connecting band has an outer exposed surface extending in a direction along a length of the limb or extremity away from a joint between a torso and the limb or extremity of the wearer.

32. An article of clothing according to claim 19, wherein:
the connecting band is assembled to the inner and outer portions along a first seam extending along a first edge of the connecting band; and along a second seam extending along a second edge of the connecting band, said first and second edges of the connecting band being spaced apart along a width of the connecting band.

33. An article of clothing according to claim 19, wherein:
in a single transverse cross section extending through the inner portion, through the outer portion, and through the connecting band, said space is located between the outer portion and the underlying surface of the inner portion.

* * * * *

UNITED STATES PATENT AND TRADEMARK OFFICE

CERTIFICATE OF CORRECTION

PATENT NO. : 7,849,522 B2
APPLICATION NO. : 11/780308
DATED : December 14, 2010
INVENTOR(S) : Isabelle Roux It is certified that error appears in the above-identified patent and that said Letters Patent is hereby corrected as shown below:

Column 5, lines 45-46 (claim 1, lines 15-16), are corrected by deleting the phrase "extending in an area of the connecting band" so as to read in their entirety as follows:

-- the connecting band is located in a crotch area of an article of clothing; --

Column 5, line 63 (claim 7, line 1), is corrected by deleting the phrase "according to claim 3, wherein" so that column 5, lines 63-64 (claim 7, lines 1-2) read in their entirety as follows:

-- 7. An article of clothing comprising: --

Column 8, line 21 (claim 26, line 17), is corrected by adding "," after "portion" so as to read in its entirety as follows:

-- between the two spaced-apart edges of the outer portion, --

Signed and Sealed this
Thirteenth Day of March, 2012

David J. Kappos

David J. Kappos
*Director of the United States Patent and Trademark Office*